US005496204A

United States Patent [19]

Brown et al.

[11] Patent Number: 5,496,204

[45] Date of Patent: Mar. 5, 1996

[54] ROTATING JUMPING APPARATUS

[75] Inventors: Rosalie E. Brown, Monterey; Geoffrey H. Willis, Berkeley; Douglas M. Brown, Monterey, all of Calif.

[73] Assignee: Outside Design Corporation, Monterey, Calif.

[21] Appl. No.: 279,230

[22] Filed: Jul. 22, 1994

[51] Int. Cl.[6] ..... A63H 1/00; A63B 5/22

[52] U.S. Cl. ..... 446/236; 482/81; 472/10; 273/440

[58] Field of Search ..... 482/81, 82, 84; 472/4, 5, 6, 8, 10; 119/701, 702, 772, 780; 273/440, 454, 455, 460, 26 E; 446/236, 242, 381, 485, 491, 30, 31

[56] References Cited

U.S. PATENT DOCUMENTS

| | | | |
|---|---|---|---|
| 956,838 | 5/1910 | Treanor | 482/81 |
| 2,643,882 | 6/1953 | Dozier | 472/8 |
| 3,010,247 | 11/1961 | Shapiro | 472/6 X |
| 3,104,104 | 9/1963 | Wood | 482/81 |
| 3,241,832 | 3/1966 | Miller . | |
| 3,408,070 | 10/1968 | Gonzales et al. | 273/26 E |
| 3,475,023 | 10/1969 | Fauvelle | 482/82 |
| 3,589,718 | 6/1971 | Bessler . | |
| 3,589,719 | 6/1971 | Glass . | |
| 3,770,268 | 11/1973 | Castello . | |
| 3,797,825 | 3/1974 | Barrett . | |
| 4,088,315 | 5/1978 | Schemmel | 482/84 X |
| 4,135,713 | 1/1979 | Martin . | |
| 4,358,110 | 11/1982 | Youkstetter | 273/455 X |
| 4,693,469 | 9/1987 | Cedar . | |
| 4,739,985 | 4/1988 | Rudell et al. | 482/81 |
| 4,813,665 | 3/1989 | Carr . | |
| 5,295,926 | 3/1994 | Tanabe | 446/473 X |

FOREIGN PATENT DOCUMENTS

| | | | |
|---|---|---|---|
| 1063424 | 12/1983 | U.S.S.R. | 482/84 |
| 1094614 | 5/1984 | U.S.S.R. | 482/84 |

*Primary Examiner*—Robert A. Hafer
*Assistant Examiner*—D. Neal Muir
*Attorney, Agent, or Firm*—Lyon & Lyon

[57] ABSTRACT

An apparatus has one or more arms extending from a rotating hub, and players jump over the arms for enjoyment or exercise. Specialized sockets or other mechanisms connect the arms to the hub such that the arms can be placed in myriad different positions, and the arms can be moved out of the way when they strike a player. Rotation of the hub can be motorized, with a mechanism for automatically stopping the rotation when any of the arms is dislocated from its socket.

29 Claims, 5 Drawing Sheets

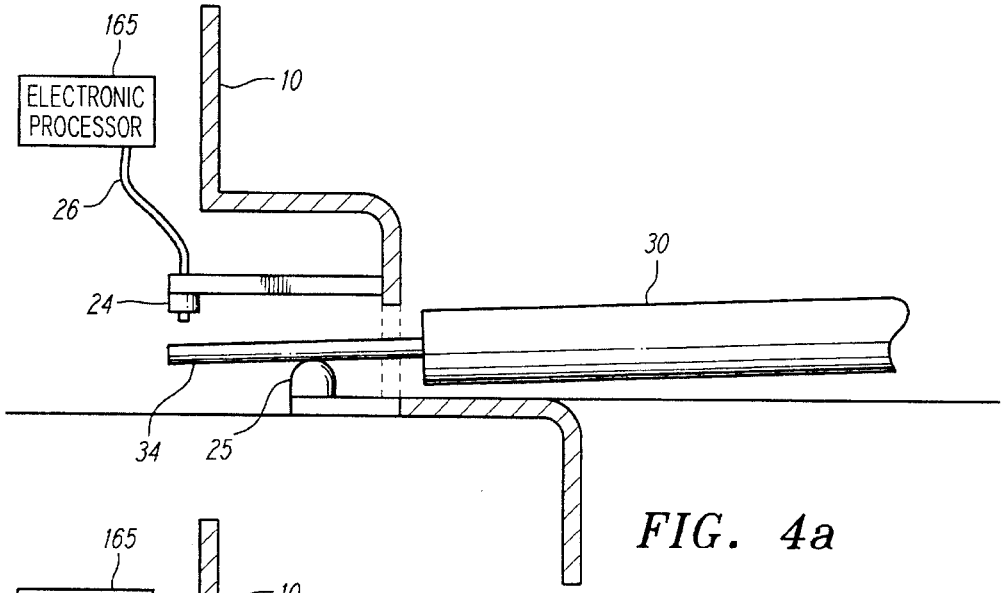
FIG. 4a
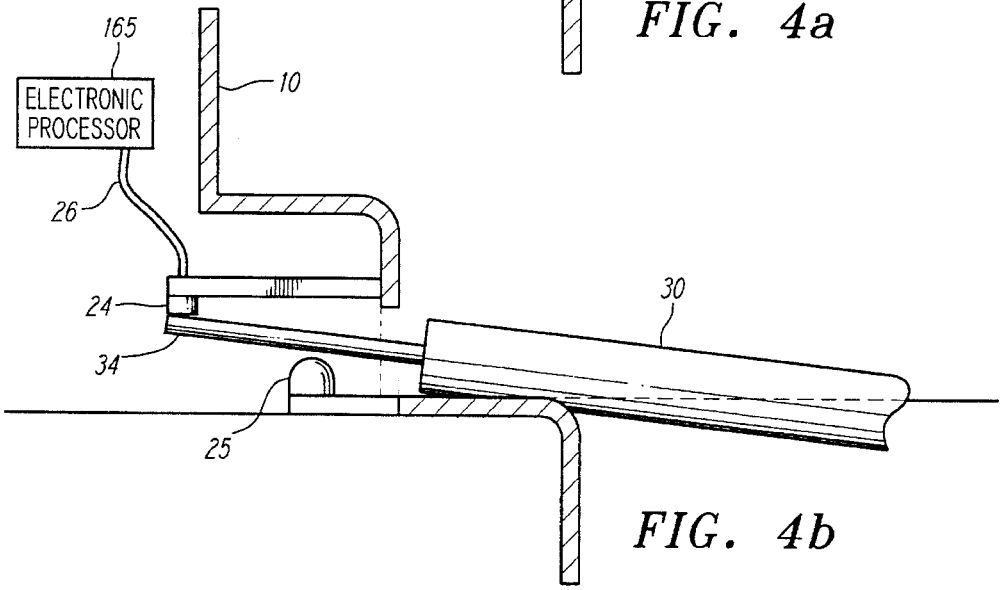
FIG. 4b
FIG. 5
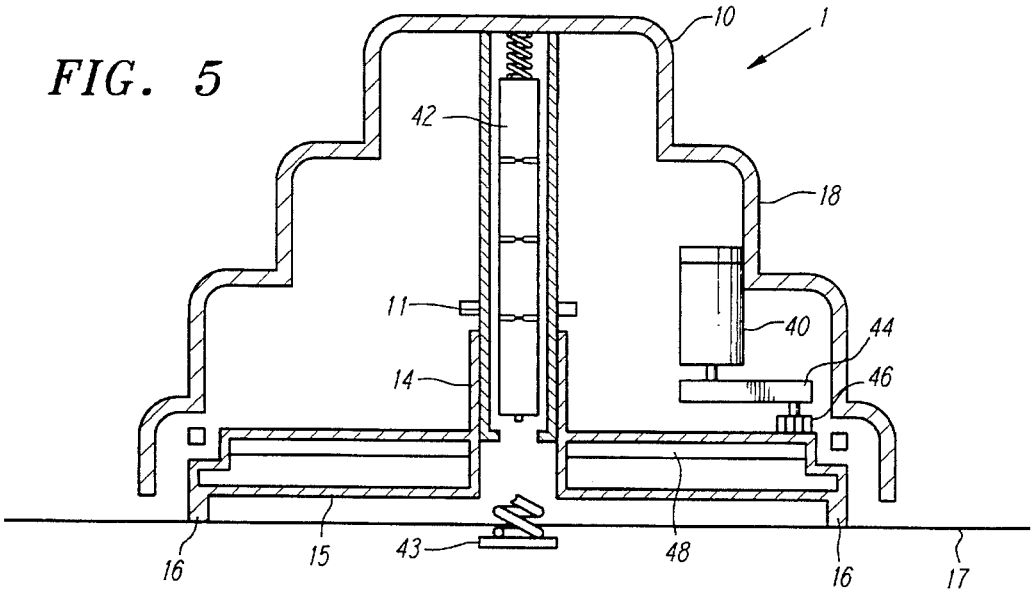

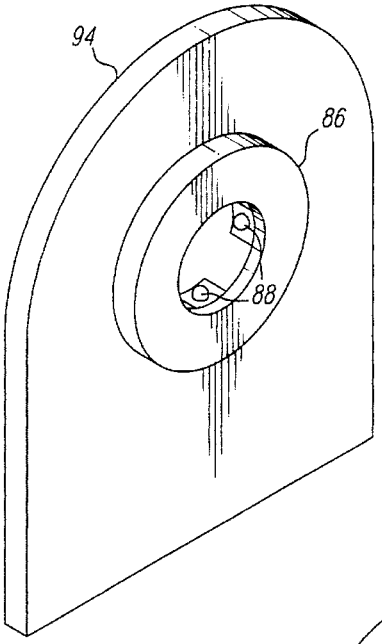
FIG. 10
FIG. 11
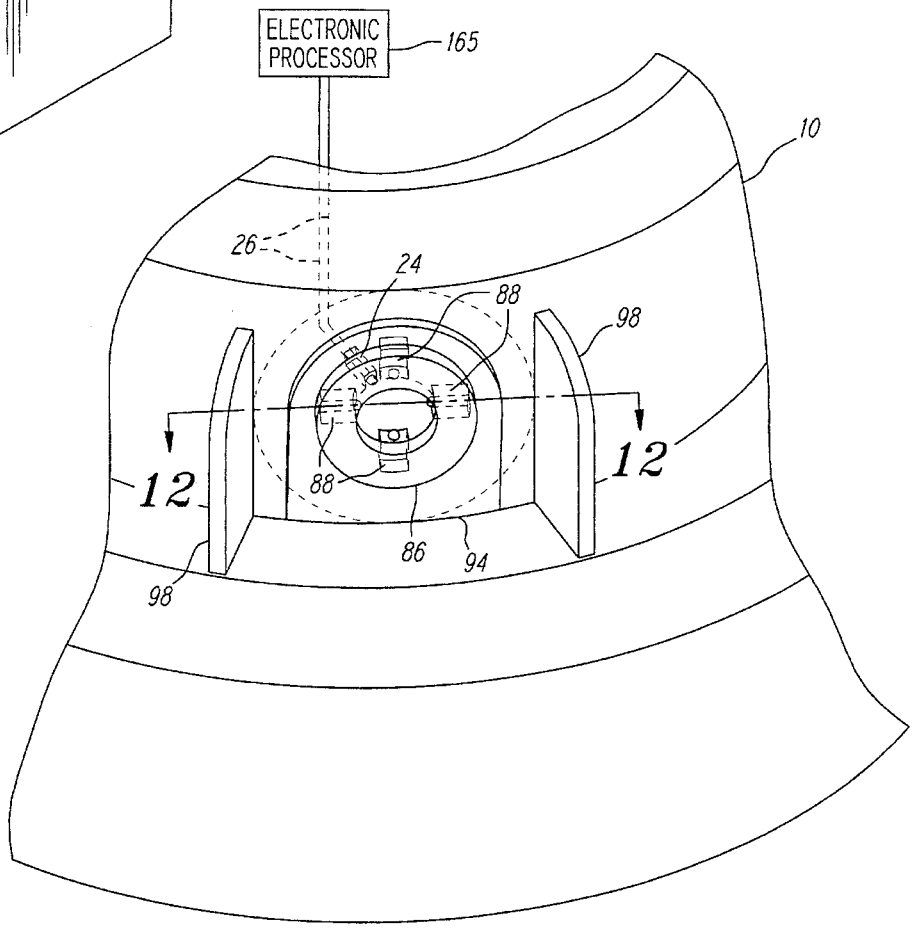
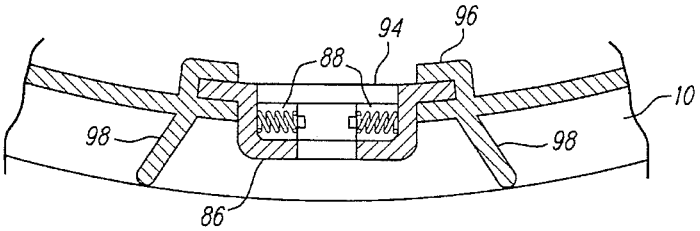
FIG. 12

ROTATING JUMPING APPARATUS

BACKGROUND OF THE INVENTION

The present invention relates to the field of toys and exercise equipment.

Both adults and children can find enjoyment and exercise in jumping and skipping. Despite the existence of many devices and games which encourage such activities, including skipping rope and hopscotch, individuals may grow tired of existing devices and desire new jumping apparatus and games.

SUMMARY OF THE INVENTION

To these ends, in a jumping apparatus, at least one arm extends from a rotating hub. Players jump over the rotating arm(s) until one of the arms strikes a player's leg. At that point either the rotation can be automatically stopped and the game terminated, or rotation can be continued pending some other event. Many different games can be played, for example, by placing the arms at different positions around the hub, changing the speed of rotation, using different colored arms, adding music or blinking lights, or using jumping pads.

Accordingly, it is an object of the invention to provide an improved jumping toy and exercise apparatus.

BRIEF DESCRIPTION OF THE DRAWING

In the drawings, wherein similar reference characters denote similar elements throughout the several views:

FIGS. 4*a* and 4*b* are schematic illustrations of a socket engagement mechanism.

FIG. 5 is a vertical cross-section through the hub of the apparatus of FIG. 1.

FIG. 10 is a perspective view of a mounting plate and socket.

FIG. 11 is a perspective view of a portion of a hub showing an alternative ball-and-socket embodiment.

FIG. 12 is a cross-section of FIG. 11 taken along a horizontal plane A—A.

DETAILED DESCRIPTION OF THE PREFERRED EMBODIMENTS

Figure 1:
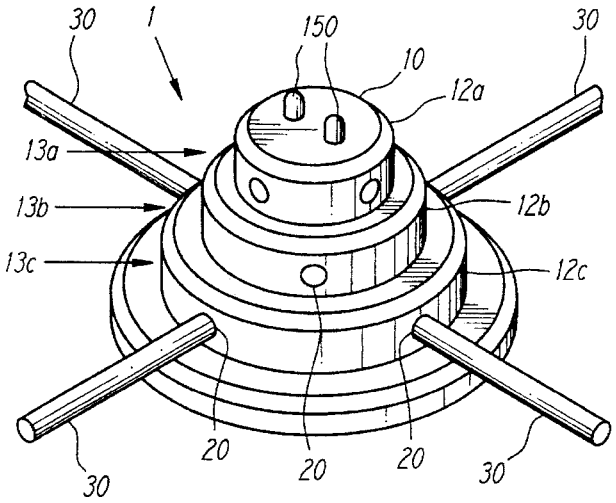
FIG. 1 is a perspective view of an apparatus according to a preferred embodiment.

Turning now to the drawings, FIG. 1 shows an apparatus 1 having a hub 10 and multiple arms 30. The arms 30 are attached to the hub 10 at sockets 20.

Hub 10 serves several purposes, including positioning of the arms 30 at appropriate heights and rotating the arms 30 at appropriate speeds for jumping. Experience has shown that appropriate such rotational speeds include speeds up to at least 40 revolutions per minute. Hub 10 can have myriad different shapes, either symmetrical or asymmetrical. For example, hub 10 can be hemispherical or some other rounded shape, which advantageously provides a broad surface to reduce risk of injury if a player falls against it. In a preferred embodiment, hub 10 comprises three stacked, rounded cylinders 12*a*, 12*b* and 12*c*, which are collectively referred to herein as cylinders 12, with cylinders 12 farther from the ground having progressively smaller diameters. Such a shape allows for plastic injection molding without side pulls in the injection molding tool. Hub 10 need not, however, be injection molded or even be made of plastic. Many other materials may be satisfactory, especially if they are covered with cloth or padding.

There are innumerable ways to position the sockets 20 around the hub 10. In a preferred embodiment, four sockets 20 are arranged on each of the three cylinders 12, providing three different levels 13*a*, 13*b*, 13*c* of sockets 20 and twelve sockets 20 altogether. Preferably, the height from the ground to the lowest level 13*c* is about 4 inches, the height from the ground to the middle level 13*b* is about 6.5 inches, and the height from the ground to the highest level 13*a* is about 9 inches. Through testing, it has been found that children aged 6 years could comfortably jump over arms 30 placed at the lowest level 13*c*, but had a difficult time jumping over arms 30 extending from the middle level 13*b*.

The sockets 20 on each level 13*a*, 13*b*, and 13*c* are radially spaced 90° apart, and sockets 20 on one level are staggered relative to those on adjacent levels. Additional configurations are also possible, for example, the top level 13*a* may have three sockets, the middle level 13*b* may have four sockets, and the bottom level 13*c* may have five sockets. The cylinders 12 may also be rotatable relative to each other to achieve an even greater variation in positioning of the sockets 20. As shown in FIG. 1, the arms 30 in the upper cylinder 12*a* and lower cylinder 12*c* are radially aligned.

In a preferred embodiment, only a few of the sockets 20 would likely be utilized at any one time. For example, if four arms 30 are in use, they might all be inserted into the sockets 20 of level 13*c*, leaving the sockets of levels 13*a* and 13*b* empty. Alternatively some of the arms 30 might be inserted into the sockets 20 of level 13*c* and some of the arms 30 might be inserted into the sockets 20 of level 13*b*. While such variation is not necessary, it may increase the fun and interest of the player(s). Each configuration of arms forces a new rhythm of jumping by the players. This learning of new rhythms may in turn help the player learn and enjoy other activities which require rhythm, for example music or dance. If the arms 30 are provided in an asymmetrical position or pattern, more concentration is required by the players.

Figure 2:
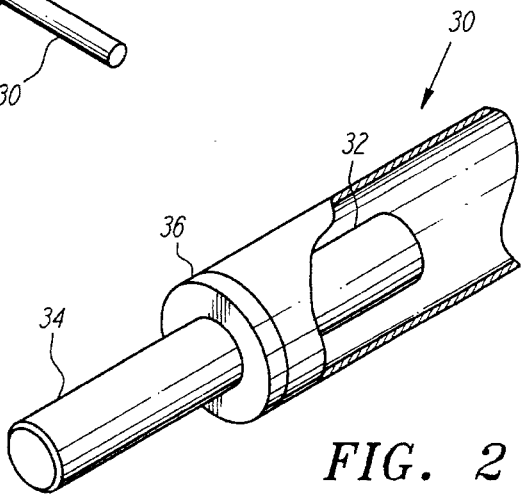
FIG. 2 is a cutaway perspective view of the proximal end of an arm.

As shown in FIG. 2, the arm 30 is advantageously made of foam, is rod shaped, and partially encloses a plastic stiffener 32. At one end of arm 30, the stiffener 32 extends into a post 34 which is dimensioned to fit into socket 20. Arms 30 are preferably constructed of soft foam to reduce the potential harm to children if they jump or fall on it. EVA (ethylene vinyl acetate) is especially preferred because it does not take a compression set. For example, if an arm 30 composed of EVA were compressed under the wright of a child's foot, it would return to its original shape. Also EVA is tough and stands up well to repeated abrasion from shoes and concrete. Further still, the use of EVA may be desirable because it can be manufactured in a wide variety of colors attractive to children. Thus, the various arms 30 of a single apparatus 1 can each have different colors, and children can add interest and fun by making up games dependent upon the colors.

Despite the benefits of EVA, arms 30 need not be composed entirely or even partially of EVA. In alternative embodiments, for example, the arms 30 could be simple thin-walled plastic tubing (not shown), closed at the end away from the hub 10. Such arms may be significantly less expensive to manufacture than EVA arms 30 with stiffeners 32, but would probably not be as soft as arms made from EVA.

In a preferred embodiment, arm 30 is extruded in the form of a tube, with an outside diameter of about 1.5 inches and an inside diameter of about 0.5 inch. These dimensions are preferred because a significantly smaller outside diameter may appear whip-like and more dangerous and intimidating to a child, and a significantly larger outside diameter may be too difficult to jump over, or to package or ship.

The preferred length for arm 30 is about 36 inches. Such a length provides ample space for a child to jump without being too close to the hub 10. Greater lengths could potentially allow more participants in a game because the arm 30 would sweep a larger area, but significantly longer lengths may also be more difficult to package and ship. With an arm length of less than about 30 inches the players will tend to jump too close to the hub 10, or on the hub 10. In alternative embodiments a single apparatus 1 may be provided with an assortment of arms 30 having different lengths.

The arm stiffener 32 is preferably plastic. Referring to FIG. 2, in a preferred embodiment the stiffener 32 extends about 14 inches into arm 30, and is held in place with glue. It is not necessary to extend the stiffener 32 the entire length of the arm 30 because the remaining foam is unlikely to droop excessively. At one end of arm 30, stiffener 32 widens out to the full outside diameter of arm 30 to form a hilt 36. The hilt 36 acts as a stop which prevents the post 34 from being inserted too far into sockets 20.

Figure 3:
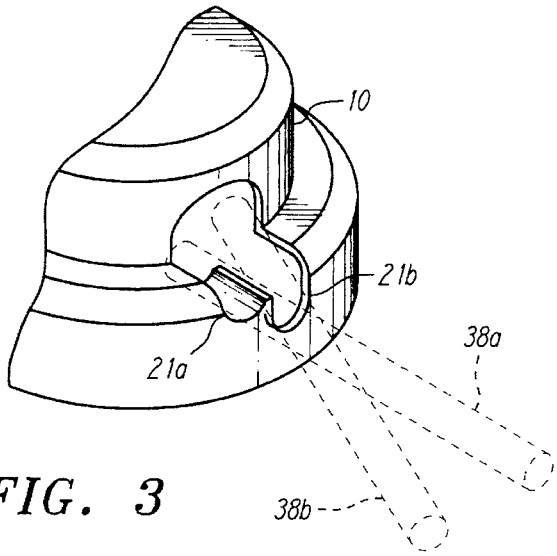
FIG. 3 is an external perspective view of a socket.

FIG. 3 shows additional details of the sockets 20. In particular, each socket 20 has an upper cradle 21*a* and a lower cradle 21*b*. Cradle 21*a* acts on post 34 to hold an arm 30 in a "normal" position 38*a*, about 5° above horizontal. Cradle 21*b* acts on post 34 to hold an arm 30 in a "down" position 38*b* shown in phantom, about 20–45° below horizontal. In general, play begins with the arm or arms 30 in the normal position 38*a*, and continues until one of the arms 30 strikes a player,, and dislocates to the down position 38*b*. Dislocation of arm 30 to the down position 38*b* may be used to signal a stop to the rotation of the hub 10, and apparatus 1 may be configured such that rotation resumes only when the arm 30 is removed or restored to the normal position 38*a*.

Several methods can be used to sense an arm 30 being dislocated to the down position 38*b*. A preferred method uses a switch 24 mounted inside each socket 20. In FIG. 4*a*, the post 34 of arm 30 rests in upper cradle 21*a* (see FIG. 3) in the normal position 38*a* without touching switch 24. In FIG. 4*b* arm 30 has struck a player and fallen into the lower cradle 21*b* (see FIG. 3), and thereby moved into the down position 38*b*. In that position post 34 operates as a lever upon fulcrum 25 to close switch 24. Switch 24 then signals an electronic processor 165 through wires 26 to disengage current to the motor, or in some other manner acts to stop rotation of the hub 10.

In an alternative embodiment hub 10 has a shock or motion sensor (not shown) mounted near the inside of its perimeter 18. After the hub 10 begins to rotate, the shock sensor can be activated by the electronic processor. If an arm 30 is dislocated from the upper position 38*a* to the lower position 38*b*, the movement will give a shock to the hub 10 which would in turn be sensed by the sensor. The sensor would then send a signal to the electronic processor to stop the rotation.

Turning to FIG. 5, hub 10 has a hollow, cylindrical, vertical axle 11 which rests upon a bearing 14 set into in a base plate 15. The base plate 15 has friction feet 16 on its underside and is set upon the floor or the ground 17. The feet 16 lift the hub 10 away from the ground 17 sufficiently to enable the apparatus 1 to be used on an uneven surface. An electric motor 40 is mounted to the inside of perimeter 18 of hub 10, and is powered by dry cell batteries 42. A cap 43 keeps the batteries 42 inside the axle 11. The motor 40 is connected via a reduction gearbox 44 to a pinion 46, which engages an internal gear 48 molded into the rim of the base 15. When current flows to the motor 40, the motor 40 causes pinion 46 to rotate internal gear 48, which in turn causes rotation of hub 10.

Alternative drive mechanisms are also possible. For example, the motor 40 could be attached to base 15 rather than hub 10, and the pinion 46 could drive an external gear (not shown) centered about axle 11. In other alternatives electric power for rotating the hub could come through a power cord (not shown) from AC house current rather than from batteries 42, rotation of the hub 10 could be achieved through a spring action without any motor, or the hub 10 could be rotated by hand and kept in motion merely by angular momentum.

Figure 6:
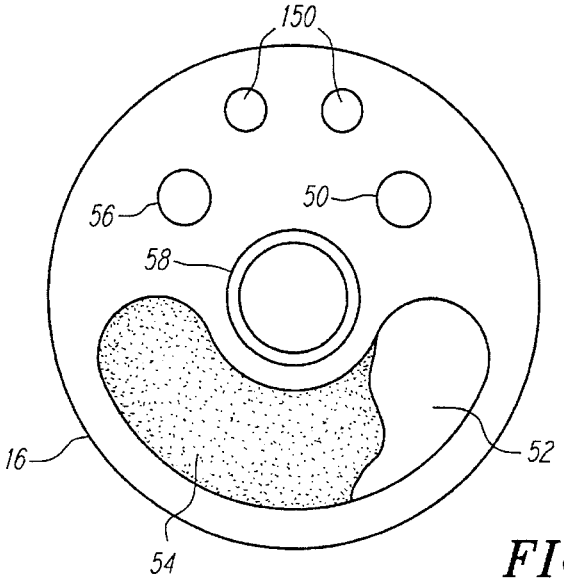
FIG. 6 is a plan view of a hub.

As shown in FIG. 6, a speed control dial 50 is used to set the rotational speed of hub 10, and thereby alter the level of difficulty. A preferred embodiment has three speeds: 20 rpm, 30 rpm, and 40 rpm, and a sound corresponding to one of the three speeds may be emitted by a loudspeaker 52 shown in cutaway under the speaker grill 54 to indicate that a selection was made. Other pre-set speeds, and a dial permitting continuously variable speeds are also possible.

Additional controls may include a game duration timer dial 56 and a restart button 58. The timer dial 56 of a preferred embodiment has two positions, one for a short game of 60 seconds and another for a long game of 5 minutes. Again, a sound may be emitted to tell which selection was made. The restart button 58 may be configured to produce a delay of a few seconds before the motion begins, to allow all players to get to their starting positions.

There may be numerous variations to the controls. For example, dials 50 and 56, and button 58 are preferably placed on the top 16 of hub 10 so that they are most accessible to the players. However in other embodiments they may be placed elsewhere. Dials 50 and 56 may also have detents (not shown) which reflect their current position during the game so that each player knows what the settings are. In still other embodiments the dials 50 and 56 can be replaced or supplemented with push-button controls, and lights can be used to show activation.

During rotation of the hub 10, the electronic processor 165 may be used to play prerecorded sounds or voice phrases, either at random or according to some pattern. Pre-recorded phrases, for example, may include words of encouragement, and pre-recorded sounds may include victory milestones like clapping or cheering after the players have reached a set time. Because the game may be more fun with music, a tape player (not shown) can be located inside the hub to provide the music. Flashing lights 150 may also be added to the surface of the hub 10 to add more excitement.

Figure 7:
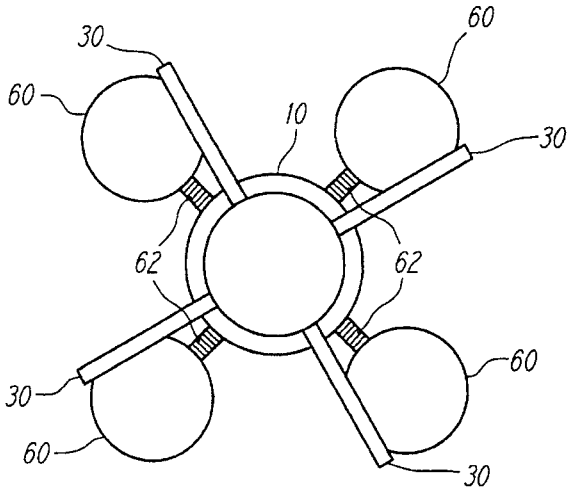
FIG. 7 is a plan view of an apparatus with positioning pads.

In FIG. 7, the play surface can be divided into areas delineated by one or more individual plastic circular pads 60 surrounding hub 10. The players jump in place on the pads 60, which in turn serve to keep the players' positions from shifting around during play. The pads 60 can be connected either to the base 15 or to each other with nylon straps 62, both of which may help stabilize the pads 60 on the floor while they are being jumped upon. The pads 60 can be stored on the underside of the base 15 when not in use, and an elastic strap (not shown) may be employed to secure the pads 60 in place.

Alternatively, the play surface could be a mat (not shown) surrounding the hub 10, upon which is printed or embossed each player's individual jumping area. These individual jumping areas can be designated by multiple colors. The pad(s) 62 or jumping areas(s) can be round, square, or irregular, such as the shape of a lily pad. They may also have a compressible foam layer underneath to absorb shock and to help give a "bounce" to the player.

Figure 8:
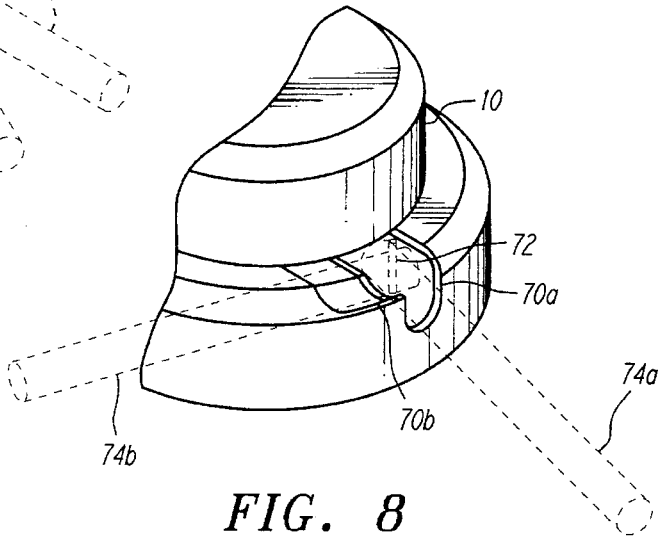
FIG. 8 is a schematic illustration of an alternative socket engagement mechanism.

FIG. 8 shows an alternative embodiment for coupling the arms 30 with the hub 10. Two cooperating cradles 70*a* and 70*b* are substantially perpendicular to each other, and the arms 30 are attached to the hub 10 through simple vertical pivots 72. When one of the arms 30 strikes a player, that arm 30 moves from a radial position 74*a* to a tangential position 74*b*, and thereby moves out of the way of the player. In this embodiment a push-button switch (not shown) can double as a friction mechanism for keeping the arm 30 in the radial position 74*a*, and can pop out when the arm 30 moves to the tangential position 74*b*.

FIGS. 9–15 show preferred embodiments for coupling arms 30 with hub 10. Each of these embodiments, which utilize ball-and-socket type of coupling, are similar to the couplings of FIGS. 1–8 in that an arm moves between a first position in which the arm is extending more or less 90° from the surface of the hub 10, (i.e. normal to the surface of the hub), and is relatively more likely to strike a player, and a second position in which the arm has moved to a position which is relatively less likely to strike a player. In FIGS. 9–15, however, the second position is such that the arm 30 may be completely detached from the hub 10.

Figure 9:
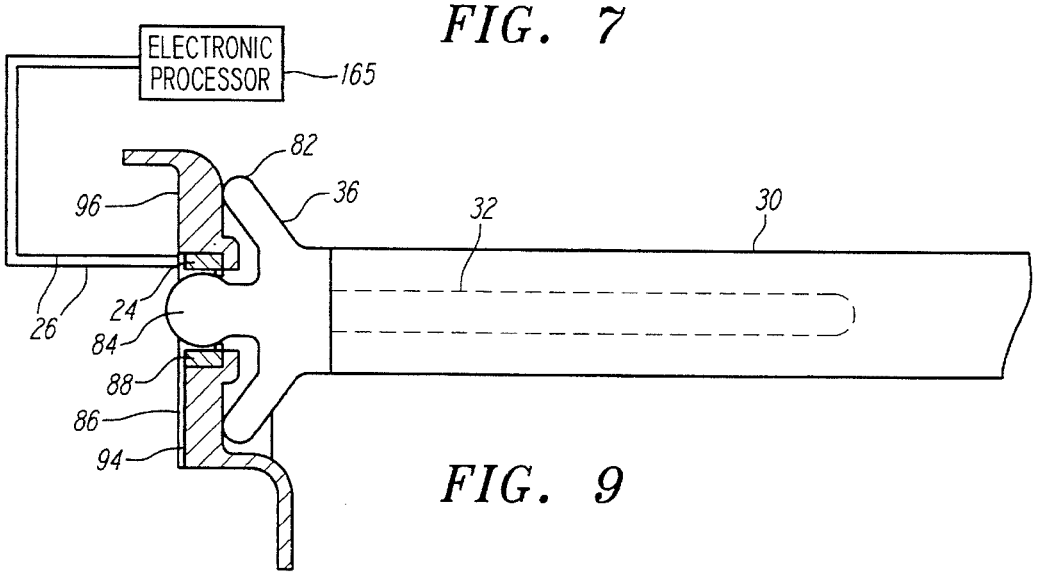
FIG. 9 is a vertical cross-section of a preferred connection between an arm and a socket.

In FIG. 9, the hilt 36 of arm 30 has a circular lip 82 and a ball-shaped knob 84. The knob 84 is received by a socket 86, and is maintained in place by the spring detents 88. In this configuration the hilt 36 acts as a lever and advantageously permits the arm 30 to be detached from the socket 86 with force from virtually any direction, as for example, if a child jumps on top of the arm 30. As in previously described embodiments, a switch 24 can be used to detect presence of the knob 84 in the socket 86, and can signal an electronic processor 165 through wires 26.

As advantageously seen in FIGS. 9–12, the socket 86 can be mounted onto or within a mounting plate 94, and the mounting plate 94 can be fixed within a track portion 96 of the hub 10. Guides 98 formed into or attached to hub 10 may be used to direct insertion of the knob 84 into the socket 86. FIG. 12 is a cross-section of FIG. 11 at A—A, and shows a preferred arrangement of track 96, mounting plate 94, socket 86 and guides 98. Sockets 86 and mounting plates 94 can alternatively be attached to the hub 10 with glue, self-tapping screws or some other means of attachment.

Figure 13:
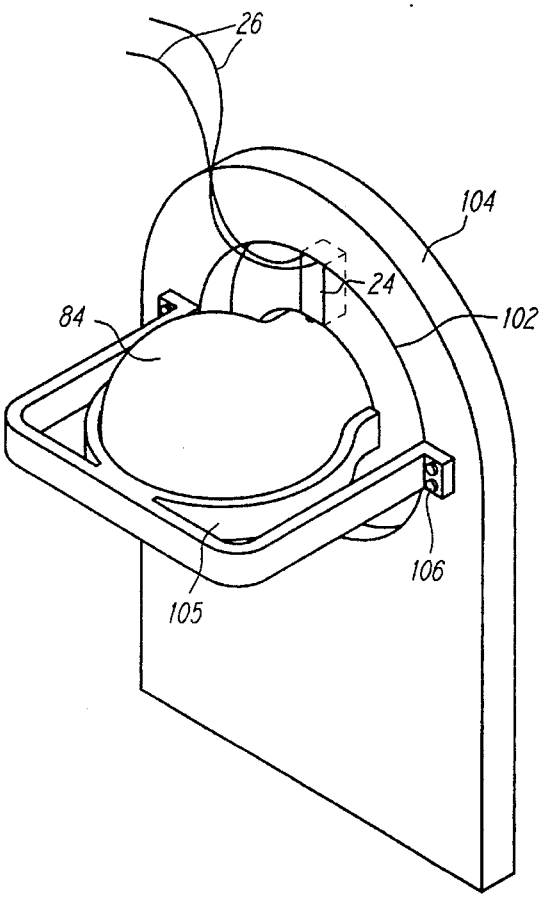
FIG. 13 is a perspective view of another alternative ball-and-socket embodiment.

FIG. 13 shows an alternative ball-and-socket embodiment for coupling the knob 84 to the hub 10. In this embodiment socket 102 is formed onto or within a mounting plate 104, and a leaf-spring 105 is used to maintain the position of the knob 84 within the socket 102. The leaf-spring 105 can be attached to the mounting plate 104 with screws 106, glue, welding or other means. A switch 24 and wires 26 detect presence or absence of the knob 84 and convey this information to the microprocessor 165.

Figure 14:
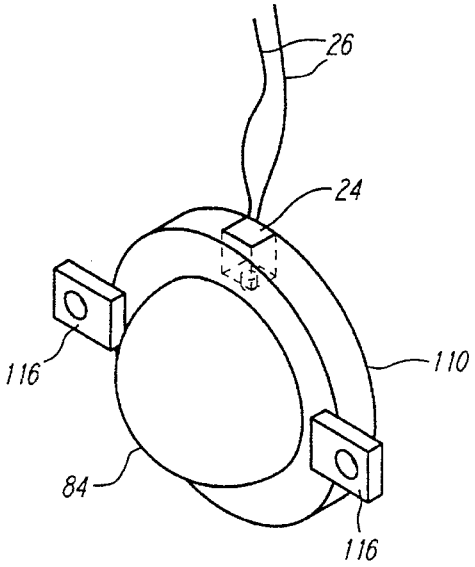
FIG. 14 is a perspective view of another alternative embodiment of a coupling between an arm and a socket.
Figure 15:
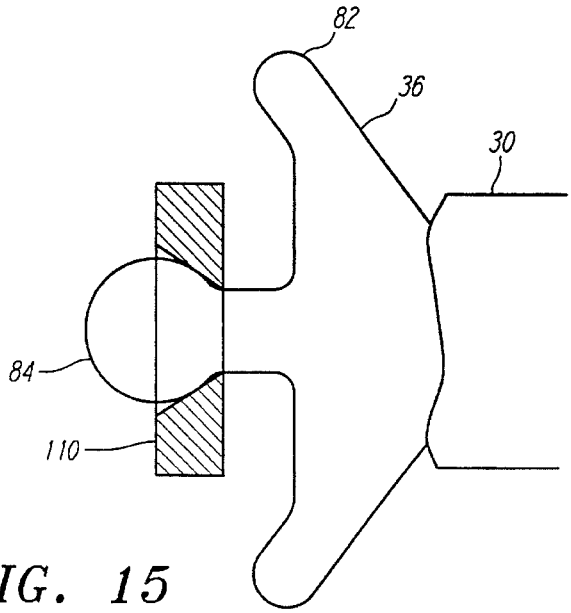
FIG. 15 is a vertical cross-section of the coupling between the arm and the socket shown FIG. 14.

FIGS. 14 and 15 show yet another ball-and-socket embodiment for coupling the knob 84 to the hub 10. In this embodiment an elastomeric ring 110 holds the knob 84 of arm 30. Supports 116 attach the ring 110 to the hub 10 or a mounting plate (not shown in FIG. 13). Switch 24 and wires 26 detect presence or absence of the knob 84 and convey this information to the microprocessor. Guides (not shown) similar to those of FIGS. 11 and 12 may advantageously be used with the embodiments of FIGS. 13–15.

Thus, a rotating jumping apparatus has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An apparatus comprising:

a base;

a hub rotatably attached to said base, said hub comprising a first cylindrical portion comprising a first circumference and a second cylindrical portion comprising a second circumference, said second cylindrical portion integral with and adjacent said first cylindrical portion, said first circumference greater than said second circumference;

a rotator mounted in said hub, said rotator drive in communication with said hub such that when said rotator drive rotates, said hub rotates;

at least one socket, said at least one socket disposed in said first cylindrical portion, said at least one socket comprising a flat surround;

a spring detent disposed in said at least one socket;

a switch disposed in said socket, said switch in communication with said rotator drive such that when said switch is in a first position, said rotator drive rotates and when said switch is in a second position, said rotator drive does not rotate, said switch biased to said second position; and at least one arm, said at least one arm comprising a first end and a second end, said first end comprising a hilt comprising a circular lip and a ball, said at least one arm removably inserted in one of said at least one socket, said circular lip abutting said flat surround, said spring detent maintaining said ball in said at least one socket, said ball holding said switch in said first position.

2. The apparatus of claim 1 wherein a second of said at least one socket is disposed in said second cylindrical portion of said hub.

3. The apparatus of claim 2 comprising more sockets than arms, whereby said arms can be inserted into said sockets in a plurality of configurations.

4. The apparatus of claim 1 further comprising an electronic processor which may emit sound.

5. The apparatus of claim 1 wherein said at least one arm is at least 30 inches in length and comprises a relatively hard internal core and a relatively soft external covering.

6. The apparatus of claim 1 wherein said rotator drive is a battery powered electric motor.

7. A apparatus comprising:

a base;

a hub rotatably attached to said base, said hub comprising a first cylindrical portion comprising a first circumference and second cylindrical portion comprising a second circumference, said second cylindrical portion integral and adjacent said first cylindrical portion, said first circumference greater than said second circumference;

a rotator drive mounted in said hub, said rotator drive in communication with said hub such that when said rotator drive rotates, said hub rotates;

at least one socket, said at least one socket disposed in said first cylindrical portion, said at least one socket comprising a flat surround;

a leaf spring disposed in said at least one socket, said leaf spring adjacent a switch, said switch being in electrical communication with said rotator drive such that when said switch is in a first position, said rotator drive rotates and when said switch is in a second position, said rotator drive does not rotate, said switch biased to said second position; and at least one arm, each of said least one arm comprising a first end and a second end, said first end comprising a hilt comprised of a circular lip and a ball, said at least one arm removably inserted in said at least one socket such that said circular lip abuts said flat surround and said ball is held in said at least one socket by said leaf sprang, said ball thereby holding said switch in said first position.

8. The apparatus of claim 7 wherein said first cylindrical portion of said hub has a plurality of said at least one socket.

9. The apparatus of claim 8 wherein said rotator drive is a battery powered electric motor.

10. An apparatus comprising:

a base having a hub rotatably mounted thereon;

a rotator drive within said hub, said rotator drive selectively rotating said hub, said hub capable of rotation about said base at a rotation speed of between zero and one-hundred rotations per minute relative to a playing area, said hub comprising a first cylinder and a second cylinder integrally stacked on said first cylinder, said first cylinder comprising a greater circumference than said second cylinder;

a first socket disposed in said first cylinder and a second socket disposed in said second cylinder, said first socket and said second socket comprising a leaf spring disposed therein, said leaf spring adjacent a switch, said switch in communication with said rotator drive; and a first arm extending from said first cylinder and positioned such that a person can jump over said first arm while said hub is rotating, said first arm comprising a circular lip and a ball, said first arm installed in said first socket such that said circular lip abuts said first cylinder and said ball is held in said first socket by said leaf spring, said ball tripping said switch when said ball is removed from said one of said at least one sockets, thereby ceasing rotation of said hub.

11. The apparatus of claim 10 wherein said first arm is at least thirty inches in length, has a relatively hard internal frame and a relatively soft exterior surface.

12. The apparatus of claim 10 wherein said hub is rotated by a battery powered electric motor.

13. The apparatus of claim 10 wherein said apparatus further comprises a an electronic processor which generates music.

14. An apparatus comprising:

a base;

a hub rotatably attached to said base, said hub comprising a first cylinder and a second cylinder integral with and adjacent said first cylinder, said first cylinder comprising a greater circumference than said second cylinder;

a rotator drive mounted in said hub, said rotator drive in communication with said hub such that when said rotator drive rotates, said hub rotates;

a first socket disposed in said first cylinder and a second socket disposed in said second cylinder, said first socket and said second socket comprising a leaf spring disposed therein, said leaf spring adjacent a switch, said switch in communication with said rotator drive; and a first arm extending from said first cylinder substantially parallel to the ground and positioned such that a person can jump over said first arm while said hub is rotating, said first arm comprising a ball, said first arm held in said first socket by said leaf spring such that said ball deflects said leaf spring and contacts said switch, thereby maintaining said switch in a first position, said switch moving to a second position when said ball is removed from said first socket, thereby ceasing rotation of said hub.

15. The apparatus of claim 14 further comprising a second arm extending from said second cylinder, said second arm substantially parallel to the ground and positioned such that a person can jump over said second arm while said hub is rotating, said second arm comprising a second ball, said second arm held in said second socket by a second leaf spring such that said second ball deflects said second leaf spring and contacts a second switch, thereby maintaining said second switch in a first position, said second switch moving to a second position when said ball is removed from said second socket, thereby ceasing rotation of said hub.

16. The apparatus of claim 14 wherein said rotator drive is a battery powered electric motor.

17. The apparatus of claim 14 wherein said apparatus further comprises an electronic processor which may emit sound.

18. The apparatus of claim 14 wherein said first arm has a relatively hard internal frame and a relatively soft exterior surface.

19. An apparatus comprising:

a base;

a hub rotatably attached to said base;

a rotator drive mounted in said hub, said rotator drive in communication with said hub such that when said rotator drive rotates, said hub rotates;

a socket in said hub, said socket comprising a first leaf spring disposed therein, said leaf spring adjacent a switch, said switch in communication with said rotator drive such that when said switch is in a first position, said rotator drive rotates and when said switch is in a second position, said rotator drive does not rotate, said switch biased to said second position; and an arm extending from said hub substantially parallel to the ground and positioned such that a person can jump over said arm while said hub is rotating, said arm comprising a ball, said arm removably inserted in said socket by inserting said ball into said socket, said ball deflecting said leaf spring, said socket holding said arm in said socket while deflecting said switch to said first position.

20. The apparatus of claim 19 wherein said rotator drive comprises a battery powered electric motor,

21. The apparatus of claim 19 wherein said apparatus further comprises an electronic processor that generates music while said hub is rotating.

22. The apparatus of claim 19 wherein said arm has a relatively hard internal frame and a relatively soft exterior surface.

23. An apparatus comprising:

a hub capable of rotation about a base at a rotation speed of between zero and one-hundred rotations per minute relative to a playing area;

a first socket disposed in said hub, said leaf spring adjacent a switch; and a first arm extending from said hub and positioned such that a person can jump over said first arm while said hub is rotating, said first arm comprising a circular lip and a ball, said first arm installed in said first socket such that said circular lip rests on said hub and said ball is maintained in said first socket by said leaf spring, said ball tripping said switch when said ball is removed from said one of said at least one sockets, thereby ceasing rotation of said hub.

24. A apparatus comprising:

a base;

a hub rotatably attached to said base, said hub comprising a first cylindrical portion comprising a first circumference and second cylindrical portion comprising a second circumference, said second cylindrical portion integrally stacked on said first cylindrical portion, said first circumference greater than said second circumference;

drive means for rotating said hub about said base;

at least one socket, said at least one socket disposed in said first cylindrical portion, each of said at least one socket comprising a flat surround;

a spring detent disposed in each of said at least one socket;

a switch disposed in each of said at least one socket, said switch in communication with said drive means; and at least one arm, each of said least one arm comprising a proximal end and a distal end, said proximal end comprising a hilt comprised of a circular lip and a ball, each of said at least one arm installable in one of said at least one socket such that said circular lip rests on said flat surround and said ball is maintained in said one of said at least one socket by said spring detent, said ball tripping said switch when said ball is removed from said one of said at least one sockets, thereby ceasing operation of said drive means.

25. The apparatus of claim 24 wherein a second of said at least one socket is disposed in said second cylindrical portion of said hub.

26. The apparatus of claim 25 comprising more sockets than arms, whereby said arms can be inserted into said sockets in a plurality of configurations.

27. The apparatus of claim 24 further comprising processor means which may emit sound.

28. The apparatus of claim 24 wherein said at least one arm is at least 30 inches in length and comprises a relatively hard internal core and a relatively soft external covering.

29. The apparatus of claim 24 wherein said drive means said hub about said base is a battery powered electric motor.

* * * * *